US011052420B2

(12) United States Patent
Kawakami et al.

(10) Patent No.: US 11,052,420 B2
(45) **Date of Patent: *Jul. 6, 2021**

(54) LAYER-BY-LAYER COATING APPARATUS AND METHOD

(71) Applicant: 3M INNOVATIVE PROPERTIES COMPANY, St. Paul, MN (US)

(72) Inventors: Ellison G. Kawakami, St. Paul, MN (US); William Blake Kolb, Stillwater, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/767,365

(22) PCT Filed: Oct. 11, 2016

(86) PCT No.: PCT/US2016/056355

§ 371 (c)(1),
(2) Date: Apr. 11, 2018

(87) PCT Pub. No.: WO2017/066151

PCT Pub. Date: Apr. 20, 2017

(65) Prior Publication Data

US 2018/0304303 A1 Oct. 25, 2018

Related U.S. Application Data

(60) Provisional application No. 62/240,039, filed on Oct. 12, 2015.

(51) Int. Cl.

| | |
|---|---|
| ***B05C 9/06*** | (2006.01) |
| ***B05B 7/06*** | (2006.01) |
| ***B05C 9/12*** | (2006.01) |
| ***B05C 1/14*** | (2006.01) |
| ***B05C 5/02*** | (2006.01) |

(Continued)

(52) U.S. Cl.
CPC ..... *B05C 9/06* (2013.01); *B05B 7/061* (2013.01); *B05C 1/14* (2013.01); *B05C 5/027* (2013.01);

(Continued)

(58) Field of Classification Search
CPC ..... B05C 1/14; B05C 11/06; B05C 5/027; B05C 5/0254; B05C 11/025; B05C 9/12;

(Continued)

(56) References Cited

U.S. PATENT DOCUMENTS 6,406,576 B1 * 6/2002 Benedict ..... B24D 3/20 156/137
7,645,355 B2 1/2010 Bilski (Continued)

FOREIGN PATENT DOCUMENTS

WO WO 2008-030474 3/2008
WO WO 2017-066066 4/2017

OTHER PUBLICATIONS

Izquierdo, "Dipping versus Spraying: Exploring the Deposition Conditions for Speeding Up Layer-by-Layer Assembly", Langmuir, 2005, vol. 21, No. 16, pp. 7558-7567.

(Continued)

*Primary Examiner* — Laura Edwards
(74) *Attorney, Agent, or Firm* — Yufeng Dong; Eric E. Silverman

(57) ABSTRACT

Apparatus and method are described and useful for, among other things, providing a layer by layer coating of materials on a belt. A directional gas curtain producing element is used to provide a gas curtain blowing on the belt in an upstream direction that simultaneously meters liquid from the belt and dries the belt.

9 Claims, 2 Drawing Sheets

(51) Int. Cl.

| | |
|---|---|
| ***B05B 1/02*** | (2006.01) |
| ***B05B 13/02*** | (2006.01) |
| ***B05D 7/00*** | (2006.01) |
| ***B05D 1/36*** | (2006.01) |
| ***B05D 1/02*** | (2006.01) |
| *B05D 3/04* | (2006.01) |

(52) U.S. Cl.
CPC ..... *B05C 9/12* (2013.01); *B05D 1/02* (2013.01); *B05D 1/36* (2013.01); *B05D 7/54* (2013.01); *B05B 1/02* (2013.01); *B05B 13/0221* (2013.01); *B05D 3/042* (2013.01); *B05D 3/0466* (2013.01)

(58) Field of Classification Search
CPC ..... B05C 11/026; B05C 11/028; B05C 9/06; B05B 7/061; B05B 1/14; B05B 1/02; B05B 14/30; B05B 13/0221
USPC ..... 118/106, 313, 314, 239, 255
See application file for complete search history.

(56) References Cited

U.S. PATENT DOCUMENTS

| | | | | |
|---|---|---|---|---|
| 7,707,963 | B2 | 5/2010 | Ciliske | |
| 8,234,998 | B2 | 8/2012 | Krogman | |
| 8,585,826 | B2 | 11/2013 | Schreiber | |
| 8,794,175 | B2 | 8/2014 | Kotov | |
| 2002/0136838 | A1* | 9/2002 | Kanke | B05C 5/007 427/420 |
| 2004/0157047 | A1 | 8/2004 | Mehrabi | |
| 2004/0235406 | A1* | 11/2004 | Duescher | B24D 11/001 451/527 |
| 2007/0032869 | A1 | 2/2007 | Gilliard | |
| 2011/0220147 | A1* | 9/2011 | Schreiber | B08B 1/02 134/15 |
| 2014/0079884 | A1* | 3/2014 | Krogman | B05D 7/56 427/352 |

OTHER PUBLICATIONS

Schlenoff, "Sprayed Polyelectrolyte Multilayers", Langmuir, 2000, vol. 16, No. 26, pp. 9968-9969.
Seyrek, "Layer-by-Layer Assembly of Multifunctional Hybrid Materials and Nanoscale Devices", Polymer Science: A Comprehensive Reference, 2012, vol. 7, pp. 159-185.
Shim, "Nanostructured Thin Films Made by Dewetting Method of Layer-By-Layer Assembly", Nano Letters, 2007, vol. 7, No. 11, pp. 3266-3273.
International Search Report for PCT International Application No. PCT/US2016/056355, dated Dec. 20, 2016, 4 pages.

* cited by examiner

LAYER-BY-LAYER COATING APPARATUS AND METHOD

CROSS REFERENCE TO RELATED APPLICATIONS

This application is a national stage filing under 35 U.S.C. 371 of PCT/US2016/056355, filed Oct. 11, 2016, which claims the benefit of U.S. Patent Application No. 62/240,039, filed Oct. 12, 2015, the disclosure of which is incorporated by reference in its/their entirety herein.

TECHNICAL FIELD

The disclosure relates to an apparatus for layer-by-layer coating as well as methods of layer-by-layer coating.

BACKGROUND

Layer-by-layer (sometimes known as LBL) coating is known in the art, and was traditionally performed by a dip-coating technique wherein a substrate was dipped in a polycation solution to deposit a monolayer of polycation. The substrate was removed from the polycation solution, rinsed to remove excess polycation, dipped into a polyanion solution to deposit a monolayer of polyanion, removed from the polyanion solution, and finally rinsed again to remove excess polyanion. The result of that process was a bilayer deposited on a surface of the substrate. The process could be repeated to obtain the desired number of bilayers.

A variety of substances have been used for the various monolayers of the LBL bilayer. Typically, the two monolayers are chosen so that each of the monolayers binds or adheres only to the other monolayer (and, in the case of the first deposited monolayer, to the substrate) but not to itself.

SUMMARY

An apparatus as disclosed herein can comprise a first roller for moving a belt, a second roller for moving a belt, a belt tensioned around the first roller and the second roller, and a deposition station positioned to face the belt, the deposition station comprising: (1) a first depositing element for affixing a monolayer of a first self-limiting monolayer forming material to the belt, (2) a rinsing element, and (3) a second depositing element for affixing a monolayer a second self-limiting monolayer forming material to the belt. The apparatus can also include a directional gas curtain producing element and positioned downstream from the deposition station to provide a gas curtain blowing on the belt in an upstream direction. Methods of applying coatings, for example, using said apparatus, are also disclosed.

DETAILED DESCRIPTION

Figure 1:
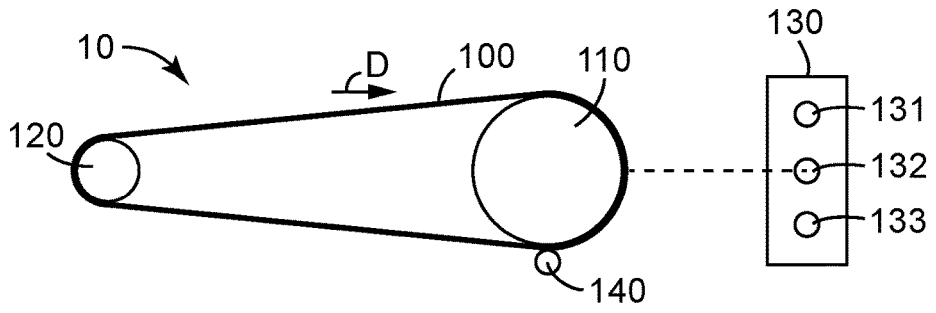
FIG. 1 is a schematic of an apparatus as described herein.

Throughout this disclosure, singular forms such as "a," "an," and "the" are often used for convenience; however, it should be understood that the singular forms are meant to include the plural unless the singular alone is explicitly specified or is clearly indicated by the context.

An apparatus can include a first and second roller for moving a belt. The first and second rollers can be made of any suitable material. Suitable materials include metal, ceramic, plastic, and rubber, including another material covered in rubber. The rollers can be of any suitable size. The width of the rollers will depend on the width of the belt that is used. In most cases, the rollers will be the same width or slightly wider than the belt. The diameter of the rollers will depend on factors such as on the available space for the device. While no particular diameter is required, some suitable rollers can have a diameter of, for example, 5 cm to 50 cm; some exemplary rollers used by the inventors have a diameter of 25.4 cm.

One or more additional rollers can be employed to direct the belt along a particular route. Other elements, such as one or more steering units can also be used for this purpose. One or more tension controllers can be used to maintain appropriate tension in the belt.

The belt can be the substrate on which the various layers are deposited. The belt can be any substance that can be used as a substrate for LBL deposition. Exemplary substrates include polymers, fabric, paper, or a transfer adhesive film, such as a transfer adhesive film containing microspheres. Polymers that can be used include polyester, such as polyethylene terephthalate, particularly as available under the trade designation MELINEX from E. I. DuPont de Nemours and Co. (Wilmington, Del., USA) polycarbonate, polyvinylchloride, polyvinylidenechloride, sulfonated polyester, acrylics, such as polymers or copolymers of acrylic acid, acrylic acid esters, methacrylic acid, methacrylic acid esters, and the like, and polyurethanes. Fabrics can include medical fabrics, textiles, and the like. Papers can include any sort of cellulose or cellulosic-based film. A transfer adhesive film can be used. Suitable transfer adhesive films are known in the art, and can be made, for example according to the methods described in U.S. Pat. No. 7,645,355.

A belt often has a first major surface and a second major surface. The major surfaces are the two surfaces having the greater width and surface area. The first major surface is typically on the opposite side of the second major surfaces. A belt can also have two other surfaces representing the height of the belt; these surfaces can be referred to as the first and second minor surfaces.

The belt can be an endless belt. In such cases, the belt is a loop with no beginning and no end. Alternatively, the belt can have a distinct beginning and a distinct end.

The first or second major surface of the belt can be suitable for bonding, adsorbing, or coating with a first self-limiting monolayer forming material. If the surface is not suitable for this purpose, it can be treated by any appropriate method to render it suitable. Typically, such surface modification is by way of plasma or corona treatment to make the surface more hydrophilic. A variety of plasma treatment methods are known, and any suitable method can be used. One suitable method of plasma treatment is described in U.S. Pat. No. 7,707,963. One suitable treated film is commercially available under the trade designation SKYROL from SKC, Inc (Covington, Ga., USA).

To facilitate various materials, such as the first and second self-limiting monolayer forming materials, being coated on the belt in an essentially uniform manner, that is, having a thickness that is essentially uniform across the width of the belt, it can be advantageous to position the belt in the apparatus such that, for at least a portion of the belt pathway, the first and second major surfaces of the belt are parallel or nearly parallel to the ground. Specifically, the belt is typically positioned so that it is within 5 degrees of parallel to the ground. In particular, the portions of the belt that are opposite the deposition station or stations are, in most cases, within 5 degrees of parallel to the ground, or more particularly parallel to the ground.

A deposition station, which comprises a first depositing element, is typically positioned to face a first major surface of the belt. Thus, the first depositing element is designed to affix at least one monolayer of a first self-limiting monolayer forming material to the belt, often to the first major surface of the belt. Suitable first depositing elements include rod coaters, knife coaters, air knife coaters, blade coaters, roll coaters, slot coaters, slide coaters, curtain coaters, gravure coaters, and sprayers. Most commonly, one or more sprayers are used.

The deposition station can also include a second depositing element. The second depositing element is typically downstream from the first depositing element. Typically, the second depositing element is also positioned to face the first major surface, that is, the same major surface that the first depositing element faces. This is to enable the second depositing element to deposit a second self-limiting monolayer forming material onto the belt on top of the first self-limiting monolayer forming material.

The deposition station can also include a rinsing element. The rinsing element is typically located between downstream from the first deposition element and, when a second deposition element is employed, upstream from the second deposition element. The rinsing element can be any element or combination of elements that operate to apply a rinse liquid to the belt. Typically, a sprayer is used.

The rinsing element typically uses a rinsing liquid to rinse the belt. Suitable rinsing liquids include water, such as buffered water, and organic solvents, such as benzene, toluene, xylenes, ethers, such as diethyl ether, ethyl acrylate, butyl acrylate, acetone, methyl ethyl ketone, dimethylsulfoxide, dichloromethane, chloroform, turpentine, hexanes, and the like.

It is not necessary that the entirety of the deposition station be positioned at or near the first major surface of the belt, so long as the first depositing element is positioned such that the first self-limiting monolayer forming material is applied to and affixed to the first major surface of the belt. Thus, when the first depositing element comprises a sprayer for affixing the first self-limiting monolayer forming material to the belt, the sprayer can be positioned to spray onto first major surface of the belt whereas other components of the deposition station, which can include, for example, one or more hoses, valves, and containers for storing or transporting the first self-limiting monolayer forming material, and other components, any or all of which can be positioned in one or more other locations.

The first deposition station can, in some cases, include other elements that facilitate the deposition of the first and second self-limiting monolayer forming materials. Examples of other elements that that can be present include one or more containers for holding one or more of the first and second self-limiting monolayer forming materials, one or more hoses for connecting such containers to the first and second depositing elements, a rinse liquid source, such as a water source, one or more hoses connecting the rinsing element, flow meters for the various hoses, gaskets or connectors for the various additional elements, and the like.

A second deposition station can also be employed. The second deposition station, which can be configured in the same or different manner as the first deposition station, typically has at least one depositing element, but in most cases will also include a rinsing element. In many cases, the second deposition has two depositing elements. In the most common configuration, the second deposition station has two depositing elements and a rinsing element. In some cases, two rinsing elements are employed.

Additional deposition stations can also be employed, with each successive deposition station being downstream from the succeeding deposition station. Such additional deposition stations are similar to the first or second deposition stations, described herein, and can be configured in the same manner or in a different manner from those deposition stations. Any number of deposition stations can be used, depending on the number of layers to be deposited. In some configurations, the apparatus can have a total number of deposition stations that is, for example, at least 1, at least 2, at least 5, at least 10, at least 20 at least 30, at least 40, at least 50, at least 60, at least 70, at least 80, at least 90, at least 100, at least 150, or at least 200.

The first self-limiting monolayer forming material is often a component of a first liquid. In this case, first liquid typically includes one or more liquid components as well as the first self-limiting monolayer forming material. The first self-limiting monolayer forming material can be dissolved or dispersed in the one or more liquid components. The one or more liquid components can be any suitable liquids for dissolving or dispersing the first self-limiting monolayer forming material. As such, the identity of the one or more liquid components will depend on the nature of the first self-limiting monolayer forming material. Suitable liquid components can include one or more of water, such as buffered water, and organic solvents, such as benzene toluene, xylenes, ethers, such as diethyl ether, ethyl acrylate, butyl acrylate, acetone, methyl ethyl ketone, dimethylsulfoxide, dichloromethane, chloroform, turpentine, hexanes, and the like.

A second self-limiting monolayer forming material is typically used, and can be affixed to the belt by way of the second deposition element. The second self-limiting monolayer forming material can be a component of a second liquid. The second liquid can comprise the second self-limiting monolayer forming material as well one or more of the liquid components discussed above with respect to the first liquid.

The self-limiting monolayer forming materials, such as the first and second self-limiting monolayer forming materials can be any materials that are, when applied consecutively, suitable for forming bilayers on the belt. Typically, first and second self-limiting monolayer forming materials are complementary, and are chosen such that the first self-limiting monolayer forming material does not bind to itself, but instead binds to the second self-limiting monolayer forming material and, in some cases, the belt. Complementary materials that are suitable for the first and second self-limiting monolayer forming materials are known to the artisan, and have been disclosed, for example, in *Polymer Science: A Comprehensive Reference*, Volume 7 section 7.09 (Seyrek and Decher). Exemplary materials include those that interact by electrostatic interactions, those that interact by hydrogen bonding, those that interact by base-pair interactions, those that interact by charge transfer interactions, those that interact by stereocomplexation, and those that interact by host-guest interaction.

Exemplary materials that can interact by electrostatic interaction to form LbL layers include cationic materials and anionic materials, for example, polycations and polyanions, cationic particles (which can be nanoparticles) and anionic particles (which can be nanoparticles), polycations and anionic particles (which can be nanoparticles), cationic particles (which can be nanoparticles) and polyanions, etc. Exemplary polycations include poly(allylamine hydrochloride), polydiallyldimethylammonium chloride, and polyethyleneimine. Exemplary polyanions include poly(sodium 4-styrene sulfonate), poly(acrylic acid), poly(vinyl sulfonate). Natural polyelectrolytes, such as heparin, hyaluronic acid, chitosan, humic acid, and the like, can also be used as polycations or polyanions, as the case may be. Particles with charged surfaces can include silica (which can have a positively or negatively charged surface depending on how the surface is modified), metal oxides such as titania and alumina (which like silica can have a positively or negatively charged surface depending on how the surface is modified), metals, latex, and charged protein particles.

Exemplary materials that can interact by hydrogen bonding to form LbL layers include polyaniline, polyvinylpyrrolidone, polyacrylamide, poly(vinyl alcohol), and poly(ethylene oxide). Also, particles, such as gold nanoparticles and CdSe quantum dots, can be modified with hydrogen bonding surface groups for use in LbL deposition. Typically, one hydrogen bond donor material, having a hydrogen atom bound to an oxygen or nitrogen atom, and one hydrogen bond acceptor material, having an oxygen, fluorine, or nitrogen atom with a free electron pair, are chosen as complementary materials.

Base pair interactions can form LbL layers based on, for example, the same types of base pairings that in natural or synthetic DNA or RNA.

Charge transfer interactions can form LbL bilayers wherein one layer has electron donating groups and the other has electron accepting groups. Examples of electron acceptors that can be used include, poly(maleic anhydride), poly (hexanyl viologen), carbon nanotubes, and dinitrobenxyl silsequioxane. Examples of electron donors that can be used include carbazolyl containing polymers, such as poly(carbazole styrene), organic amines, electron poor pi-conjugated polymers such as poly(dithiafulvalene), and polyethyleneimine.

Stereocomplexation can be used to form LbL layers between materials with well-defined and complementary stereochemistry, such as isotactic and syndiotactic poly (methyl methacrylate) as well as enantiomeric L- and D-polylactides.

Host guest interactions can be used to form LbL layers when a suitable host material layer is deposited on a suitable guest layer, or vice versa. Biotin and streptavidin is one host-guest pair that can be used to form LbL bilayers. Enzymes or antibodies can also be paired with their substrates to form LbL bilayers. Examples include glucose oxidase and glucose oxidase antibodies, maleimide and serum albumin.

A directional gas curtain producing element can be positioned downstream from the first deposition station and, when a second deposition station is employed, upstream from the second deposition station. The first directional gas curtain producing element typically faces the same surface of the belt as the first deposition station and, in use, provides a gas curtain blowing on the outside surface of the belt. The gas curtain is typically blown at high pressure so as to simultaneously meter (that is, physically remove or slough off) excess first self-forming monolayer material from the belt and dry (that is, encouraging or effecting evaporation) any extra liquid that remains downstream of the deposition station. The directional gas curtain producing element is typically positioned so as to be perpendicular or nearly perpendicular to the belt. Second, third, fourth, or further deposition stations can also be used. Such further deposition stations will typically have the same configuration as the deposition station, discussed above. When used, any second, third, fourth, or further deposition station can be positioned to affix additional self-limiting monolayer forming materials on either the first or second major surface of the belt.

Directional gas curtain producing elements, which are sometimes known as air knives, are known in the art and are commercially available, for example under the trade designation SUPER AIR KNIFE (EXAIR Corp., OH, USA). Such devices produce a narrow stream of forced air moving at high velocity. The stream of forced air typically has a width equal to or greater than the width of the belt, such that the entire width of the belt is engaged by the gas curtain and subjected to the forced air.

The directional gas curtain producing elements in any of the apparatuses or methods described herein can be positioned to direct a gas curtain at a desirable angle with respect to the belt. The angle is typically no less than 80°, or more particularly no less than 85°. The angle is most commonly 90°. When the angle is less than 90°, the directional gas curtain producing element is most often positioned so that the air is blown upstream, that is, towards the preceding depositing element.

The directional gas curtain producing elements in any of the apparatuses or methods described herein can be positioned at an appropriate distance to the belt. The distance between the gas outlet on a directional gas curtain producing element and the belt is sometimes known as the gap. If the gap is too large, then the web may not be sufficiently dry. The gap is typically no more than 0.8 mm, such as no more than 0.75 mm, no more than 0.7 mm, no more than 0.65 mm, no more than 0.6 mm, no more than 0.55 mm, or no more than 0.5 mm.

The flux of gas, which is typically air, through the directional gas curtain producing element is another parameter than can affect the dryness of the belt. The flux of gas is typically measured as flux per length of the gas curtain ("flux per length"); this value has units of $m^2/s$. When the flux per length is too low, then the gas curtain may not be effective at metering and drying liquid on the belt. Typical flux per length (in $m^2/s$) are no less than 0.02, no less than 0.02, no less than 0.024, no less than 0.025. no less than 0.026, no less than 0.028, or no less than 0.03.

When a second third, fourth, or further deposition stations are used to affix additional self-limiting monolayer forming materials (beyond the first and second self-limiting monolayer forming materials) to the first major surface, the various deposition elements are typically positioned so that alternating layers of complementary self-limiting monolayer forming materials are deposited on the belt. For example, if four deposition stations are used, the first deposition station can deposit cationic polydiallyldimethylammonium chloride, the second deposition station can deposit anionic poly(acrylic acid), the third deposition station can deposit modified silica particles with a cationic surface, and the fourth deposition station can deposit anionic (that is, partially deprotonated) hyalauronic acid.

If second, third, fourth, or even further deposition stations are used, each will typically have an associated directional gas curtain producing element located downstream from the associated deposition station and upstream from any subsequent deposition station. These second, third, fourth, or further directional gas curtain producing elements will typically have the same features as the directional gas curtain producing element described above.

The apparatus can also include a first backing element positioned such that at least a portion of the belt is interposed between the first backing element and the deposition station. This first backing element can be useful for preventing any excess material that may fall off of the belt from contaminating other parts of the belt or the apparatus. The first backing element can be made of any suitable material, but is typically plastic, metal, or ceramic. It can be coated with a suitable coating, such as a non-stick coating. Poly(tetrafluoroethylene) is a common non-stick coating.

The apparatus can further include a second backing element positioned such that at least a portion of the belt is interposed between the second backing element and the directional gas curtain producing element. The second backing element, when present, can serve the same purpose as the first backing element, and can be made of the same materials.

When second third, fourth, or further deposition stations or directional gas curtain producing elements are employed, corresponding additional further backing elements can be used. Each backing element can correspond to a particular deposition station or gas curtain producing element, such that a portion of the belt passes between a deposition station or a directional gas curtain producing element and its corresponding backing element. Two or more of the backing elements can be integrated, that is, they can be different parts of a single element. Such integration is not required.

Backing elements are not required. Also, it is possible that some deposition stations or directional gas curtain producing elements can have corresponding backing elements while others have no backing elements. This can be the case when a deposition station is positioned such that a portion of the belt is disposed between the deposition station and a roller. However, even when the belt is not disposed in that manner, the backing element may not be necessary.

In use, the apparatus as described herein can affix a monolayer of the first self-limiting monolayer forming material or a monolayer of the second self-limiting monolayer forming material to the belt while the belt is moving at a suitable speed. Any speed can be used so long as the monolayer is deposited on the belt. Suitable speeds can be, for example, at least 0.25 m/s, at least 0.50 m/s, at least 0.75 m/s, at least 1 m/s, at least 1.25 m/s, or at least 1.5 m/s.

An apparatus, such as that described above, can be used in a method of making a layer-by-layer coating on a substrate. The method can comprise tensioning a substrate in the form of a belt around a first roller and a second roller. The belt can then be moved around the first roller and the second roller for a first revolution while a first depositing element applies a first liquid comprising a first self-limiting monolayer forming material on the belt. A directional gas curtain producing element can be engaged to simultaneously meter liquid from the belt and dry the belt. As a result, at least a monolayer of the first self-limiting monolayer forming material is deposited on the belt.

When second, third, or further deposition stations are employed, they can be engaged to form second, third, or further monolayers of second, third, or further self-limiting monolayer forming materials.

It is possible to change any of the self-limiting monolayer forming materials during operation in order to affix more than two types of materials to the belt without employing more than one deposition station. For example, an apparatus as described herein can be arranged such that the first deposition station deposits a polyquaternium cation and the second deposition station deposits a polystyrene sulfonate anion. After affixing a layer of polyquaternium cation and a layer of polystyrene sulfonate, the polyquaternium can be replaced by another cationic material, such as polytrimethylammoniumethyl methacrylate, and the polycation can be replaced by another anionic material, such as anionic silica nanoparticles. Subsequently a layer of polytrimethylammoniumethyl methacrylate and a layer of anionic silica nanoparticles can be affixed to the belt. The resulting belt will have a layer of polyquaternium, a layer of polystyrene sulfonate, a layer of polytrimethylammoniumethyl methacrylate, and a layer of anionic silica nanoparticles. This procedure is particularly useful when space or other constraints prevent more than one deposition station from being employed.

The belt can be moved around the first roller and the second roller to alternatively layer-by-layer deposit on the belt at least one layer of the first self-limiting monolayer forming material and, if a second deposition station is deployed, at least one layer of the second self-limiting monolayer forming material. When the belt is an endless belt, the belt can revolve around the first roller and the second roller any suitable number of times, wherein each revolution adds a monolayer or a bilayer to the surface. In this type of continuous process, there is no need for the belt to stop moving until an endpoint is reached. Depending on the ultimate use of the substrate, the desired endpoint can be the deposition of a pre-determined number of monolayers, the passing of a pre-determined deposition time, achieving a pre-determined thickness, or achieving a pre-determined optical, chemical, or physical property of the coating.

When the belt has a distinct beginning and end, the apparatus can be operated in a somewhat different process as compared to the process used when the belt is endless. In an example of a process that is useful for a belt with ends, one pass through an apparatus with one deposition station can provide at least a single layer or a single bilayer on the belt. If more than one deposition station is used in the apparatus, then a single pass of the belt through the apparatus can affix additional layers. Typically, the apparatus will have one deposition station per layer that is to be deposited. However, if necessary, the belt can be removed from the apparatus and then re-loaded for additional coating starting at the beginning of the belt.

Turning to the Figures, which depict schematics of particular embodiments of apparatuses as described herein, FIG. 1 depicts apparatus 10 having belt 1 tensioned around first roller 100 and second roller 110 and moves in direction D. Additional roller 120 is also present. Deposition station 130 includes first depositing element 131, rinsing element 132 that is positioned downstream of first depositing element 131 and second depositing element 133 that is positioned downstream from rinsing element 132. Directional gas curtain producing element 140 is positioned downstream of deposition station 130.

Figure 2:
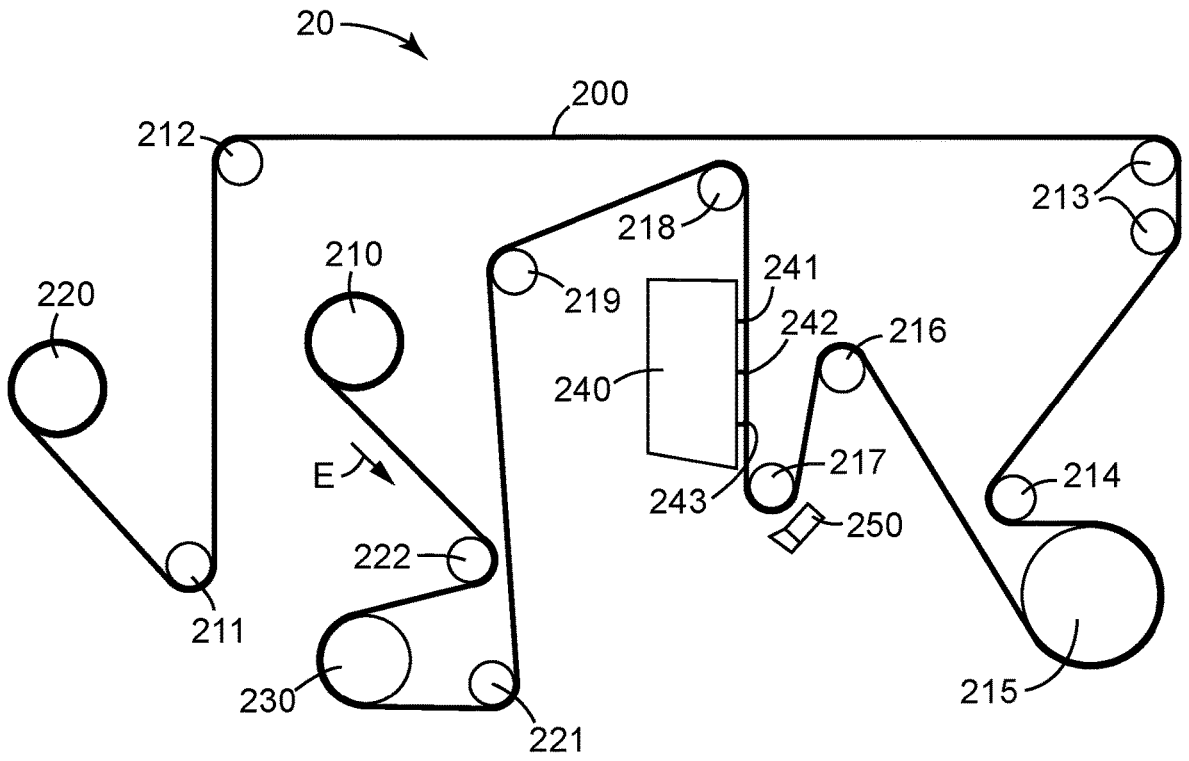
FIG. 2 is a schematic of another apparatus as described herein.

FIG. 2 depicts apparatus 20 having belt 200 tensioned around first roller 210 and second roller 220. Additional rollers 211, 212, 213, 214, 215, 216, 217, 218, 219, 221, and 222 are also present to guide and move belt 200. In use, the belt unwinds from roller 210 in direction E and passes through tension controller 230, which maintains appropriate tension in the belt. The belt then passes by deposition station 240 wherein first depositing element 241, a sprayer in this Figure, sprays a first liquid (not shown) containing a first self-limiting monolayer forming material (not shown) on the belt. Rinsing element 242 rinses excess first liquid off the belt, and second depositing element 243, a sprayer in this Figure, sprays a second liquid (not shown) containing a second self-limiting monolayer forming material (not shown) on the belt. Directional gas curtain generating element 250 is positioned downstream from deposition station 240 and simultaneously meters any remaining liquid off the belt and dries the belt.

LIST OF ILLUSTRATIVE EMBODIMENTS

The following embodiments are listed to illustrate particular features of the disclosure, and are not intended to be limiting.

Embodiment 1

An apparatus comprising
a first roller for moving a belt;
a second roller for moving a belt;
a belt tensioned around the first roller and the second roller;
a deposition station positioned to face the belt, the deposition station comprising
- a first depositing element for affixing a monolayer of a first self-limiting monolayer forming material to the belt,
- a rinsing element, and
- a second depositing element for affixing a monolayer a second self-limiting monolayer forming material to the belt; and a directional gas curtain producing element and positioned downstream from the deposition station to provide a gas curtain blowing on the belt in an upstream direction.

Embodiment 1a

The apparatus of embodiment 1, further comprising at least a second deposition station.

Embodiment 2

The apparatus of embodiment or 1a, further comprising a first backing element that is positioned such that at least a portion of the belt is interposed between the backing element and the directional gas curtain providing element.

Embodiment 3

The apparatus of any preceding embodiment, further comprising a second backing element, which may be the same or different as the first backing element, that is positioned such that at least a portion of the belt is interposed between the second backing element and the deposition station.

Embodiment 4

The apparatus of any of the preceding embodiments, wherein at least one of the first depositing element and the second depositing element is a sprayer.

Embodiment 5

The apparatus of any preceding embodiment, wherein both the first depositing element and the second depositing element are sprayers.

Embodiment 6

The apparatus of any of embodiments 1-4, wherein at least one of the first depositing element and second depositing element is a knife coater or an air knife coater.

Embodiment 7

The apparatus of any of the preceding embodiments, wherein the directional gas curtain producing element produces a directional gas curtain having a pressure sufficient to remove liquid, cationic material, or anionic material that is not affixed to the belt.

Embodiment 8

The apparatus of any of the preceding embodiments, wherein the apparatus is capable of affixing a monolayer of cationic material or anionic material to the belt while the belt is moving at a speed of at least 0.25 m/s.

Embodiment 9

The apparatus of any of the preceding embodiments, wherein the apparatus is capable of affixing a monolayer of cationic material or anionic material to the belt while the belt is moving at a speed of at least 0.5 m/s.

Embodiment 10

The apparatus of any of the preceding embodiments, wherein the apparatus is capable of affixing a monolayer of cationic material or anionic material to the belt while the belt is moving at a speed of at least 0.75 m/s.

Embodiment 11

The apparatus of any of the preceding embodiments, wherein the belt is an endless belt.

Embodiment 12

The apparatus of any of the preceding embodiments, wherein the belt has at least one end.

Embodiment 13

The apparatus of any of the preceding embodiments, wherein
the first self-limiting monolayer forming material is one and only one of a cationic material or an anionic material; and the second self-limiting monolayer forming material is one and only one of a cationic material or an anionic material; with the proviso that one and only one of the first self-limiting monolayer forming material and the second self-limiting monolayer forming material is a cationic material and the other is an anionic material.

Embodiment 14

A method of making a layer-by-layer coating on a substrate, the method comprising
(a) tensioning a substrate in the form of a belt around a first roller and a second roller such that the belt faces a deposition station,
the deposition station comprising
- a first depositing element for affixing at least a monolayer of a first self-limiting monolayer forming material to the belt, (b) moving the belt around the first roller and the second roller for a first revolution while engaging the first depositing element to apply a first liquid comprising a first self-limiting monolayer forming material on the belt;

(c) engaging a directional gas curtain producing element that is positioned downstream from the deposition station to provide a gas curtain that simultaneously meters liquid from the belt and dries the belt.

Embodiment 15

The method of embodiment 14, wherein the deposition station further comprises a rinsing element positioned downstream of the first depositing element, and a second depositing element positioned downstream from the rinsing element for affixing a monolayer of a second self-limiting monolayer forming material to the belt; and wherein the method further comprises the steps of (d) engaging the rinsing element; and (e) engaging the second deposition element to affix at least a monolayer of a second self-limiting monolayer forming material on the belt.

Embodiment 16

The method of embodiment 15, wherein the apparatus is an apparatus of any of embodiments 1-13.

Embodiment 17

The method of any of embodiments 15-16, wherein the belt is an endless belt.

Embodiment 18

The method of any of embodiments 16-17, wherein the belt does not stop moving until at least one of a pre-determined number of monolayers are deposited, a pre-determined amount of time passes, a pre-determined thickness is achieved, or a pre-determined optical, chemical, or physical property is achieved.

Embodiment 19

The method of any of embodiments 15-18 wherein the belt has a first end and a second end and wherein step (b) further comprises unwinding the belt from the first roller while rolling the belt around the second roller.

Embodiment 20

The method of embodiment 18, further comprising the steps of (f) disengaging the deposition station; and (g) rewinding the belt from the second roller to the first roller while the deposition station is disengaged.

Embodiment 21

The method of embodiment 20, wherein at each of steps (a) through (g) is repeated, in order, at least one additional time.

Embodiment 22

The method of any of embodiments 20-21, wherein the method further comprises the step of removing the belt from the second roller and replacing the belt on the first roller.

Embodiment 23

The method of any of embodiments 14-22, wherein the first self-limiting monolayer forming material is one and only one of a cationic material or an anionic material; and the second self-limiting monolayer forming material is one and only one of a cationic material or an anionic material;

with the proviso that one and only one of the first self-limiting monolayer forming material and the second self-limiting monolayer forming material is a cationic material and the other is an anionic material.

Embodiment 24

The method of any of embodiments 14-23, which is performed with an apparatus of any of embodiments 1-13.

Embodiment 25

The apparatus of method of any of the preceding embodiments, wherein at least the first directional gas curtain producing element is directed at the belt at an angle of between 80° and 90° to the belt.

Embodiment 26

The apparatus or method of any of the preceding embodiments, wherein at least the first directional gas curtain producing element is directed at the belt at an angle of between 85° and 90° to the belt.

Embodiment 27

The apparatus or method of any of the preceding embodiments, wherein at least the first directional gas curtain producing element is directed at the belt at an angle of 90° to the belt.

Embodiment 28

The apparatus or method of any of embodiments 1-13, wherein each directional gas curtain producing element is directed at the belt at the angle specified in any one of embodiments 24-27.

Embodiment 29

The apparatus or method of any of the preceding embodiments, wherein the gap between the first directional gas curtain producing element and a surface of the belt is no more than 0.8 mm, no more than 0.75 mm, no more than 0.7 mm, no more than 0.65 mm, no more than 0.6 mm, no more than 0.55 mm, or no more than 0.5 mm.

Embodiment 30

The apparatus or method of any of the preceding embodiments, wherein the gap between each directional gas curtain producing element and a surface of the belt is no more than 0.8 mm, no more than 0.75 mm, no more than 0.7 mm, no more than 0.65 mm, no more than 0.6 mm, no more than 0.55 mm, or no more than 0.5 mm.

Embodiment 31

The method of any of the preceding embodiments, wherein the flux of air per length that is produced by each directional gas curtain producing element when said element is engaged is, in units of $m^2/s$, no less than 0.02, no less than 0.02, no less than 0.024, no less than 0.025. no less than 0.026, no less than 0.028, or no less than 0.03.

Embodiment 32

The method of any of embodiments 1-30, wherein the belt moves at a speed of at least 0.25 m/s, at least 0.5 m/s, or at least 0.75 m/s for at least part of the duration of the method.

Embodiment 33

The apparatus of method of any of the preceding claims, wherein the apparatus comprises at least 2, at least 5, at least 10, at least 20, at least 30, at least 40, at least 50, at least 60, at least 60, at least 70, at least 80, at least 90, at least 100, at least 150, or at least 200 deposition stations.

EXAMPLE SECTION

Materials

Polydiallyl dimethylammonium chloride (PDAC) was used as a 20 mM (based on repeat unit mass) solution in water, had a MW of 100-200K, and was obtained as a 20 wt % solution in water from Sigma Aldrich (St. Louis, Mo., USA).

$SiO_2$ nanoparticles were used as a 9.6 g/L colloidal dispersion in water, and were obtained as a 40 wt % suspension in water from Sigma Aldrich under the trade designation Ludox AS-40.

Tetramethyl ammonium chloride (TMACLl) was obtained as a 50 wt % solution in water from Sachem Inc. (Austin, Tex.).

Tetramethyl ammonium hydroxide (TMAOH) were obtained as a 2.38 wt % solution in water from Alfa Aesar (Ward Hill, Mass.)

101.6 micron thick primed polyethylene terephthalate (PET) was obtained from SKC, Inc. under the trade designation SKYROL SH40.

Spray nozzles were obtained from Spraying Systems Co. (Wheaton, Ill. USA) under the trade designation TPU-4001E SS Branched polyethylenimine (PEI) was used as a 0.1 wt. % solution in water, had a MW of 25,000 g/mol, and was obtained from Sigma Aldrich (St. Louis, Mo., USA).

Poly(acrylic acid) (PAA) was used as a 0.2 wt. % solution in water, had a MW of 100,000 g/mol, and was obtained as a 35 wt. % solution in water from Sigma Aldrich (St. Louis, Mo., USA).

Experimental Conditions

An apparatus as described in FIG. 1 was used to generate the data described in herein. The operating conditions are described in Table 1. The PDAC was used in a concentration of 20 mM with respect to the repeat unit and the pH was adjusted to 10.0 by addition of TMAOH. The $SiO_2$ was used in a concentration of 9.6 g/L admixed with TMACl (final TMACl concentration was 48 mM), and the pH was adjusted to 11.5 by addition of TMAOH.

Thickness measurements were conducted using a Filmetics (San Diego, Calif.) F10-AR reflectometer. Samples for measurement were taken from a portion of the belt downstream of the anion deposition station and upstream of the cation deposition station in order to ensure that the samples had the same number of cation and anion layers.

TABLE 1

| | |
|---|---|
| Substrate (belt) | 101.6 micron primed PET |
| Cation | PDAC |
| Cation line pressure | 193 kPa |
| Cation flow rate | 27240 cc/min |
| Anion | $SiO_2$ |
| Anon line pressure | 275 kPa |
| Anion flow rate | 20880 cc/min |
| Rinse 1 | DI Water |
| Rinse 1 line pressure | 241 kPa |
| Rinse 1 Flow Rate | 79440 cc/min |
| Rinse 2 | DI Water |
| Rinse 2 line pressure | 310 kPa |
| Rinse 2 Flow Rate | 34080 cc/min |
| Air knife line pressure | 275 kPa |
| Air knife gap to roller | 635 micron |
| Air knife angle* | 23 degrees |
| Air knife opening | 101.6 micron |
| Belt linear velocity | 0.279 m/s |

*This refers to the air knife angle with respect to the ground. All air knives were positioned perpendicular to the roller.

Example 1

PDAC solution was sprayed for an entire revolution of the belt. This was followed by a high volume rinse step with DI water for an entire revolution, then a low volume rinse step, then by the complementary $SiO_2$ solution and another two rinse steps with DI water. Doing this process once coats a single bi-layer on the substrate. This process was repeated for a total of 7 bilayers.

Figure 3:
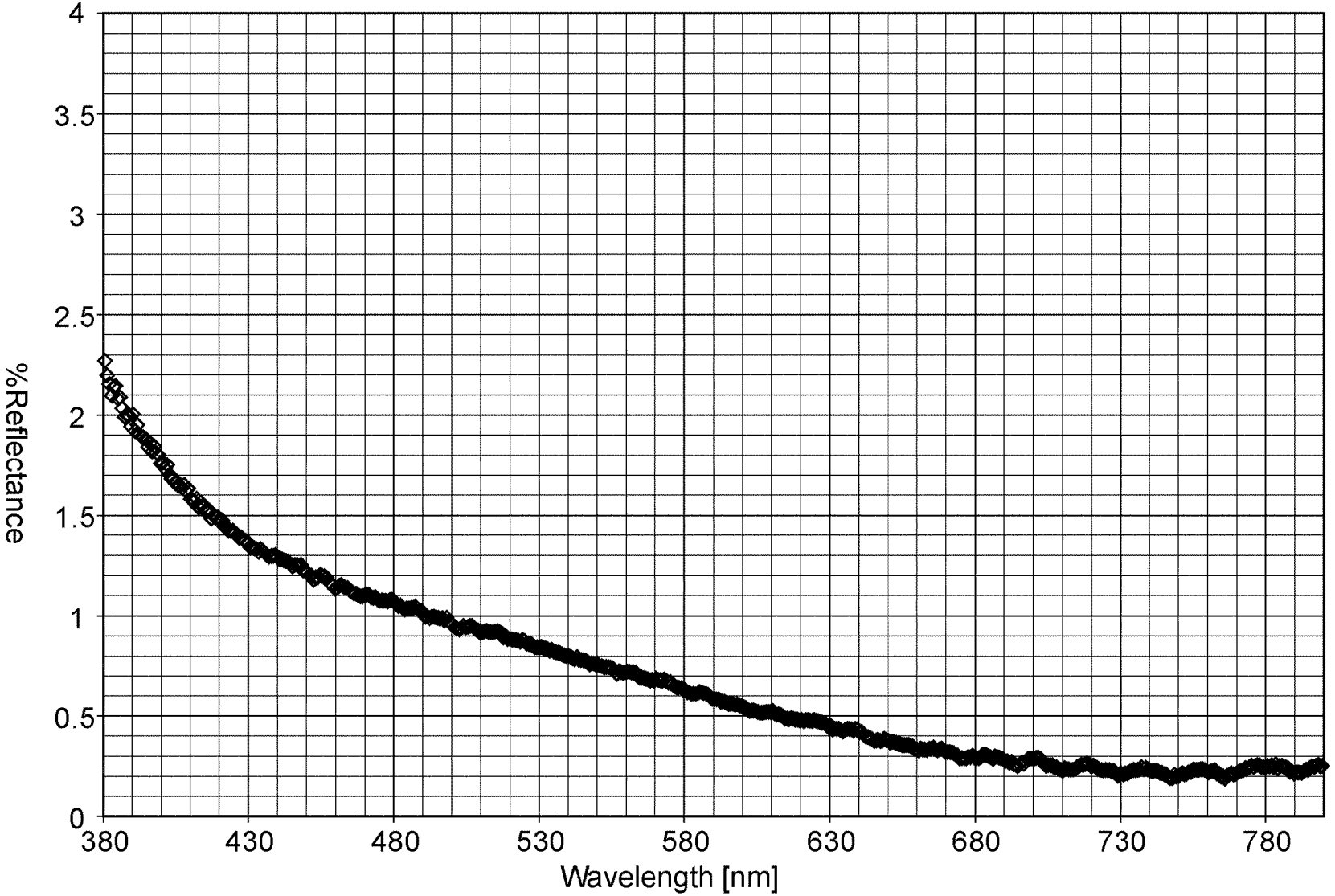
FIG. 3 is a graph of reflectance vs. wavelength.

The resulting coating had a 0.7% haze and a 95.8% transmittance of visible light (as measured with a BYK-Gardner (Geretsired, Germany) Haze Gard Plus). The coating had a thickness of 135.6 nm as measured with a Filmetrics F10-AR reflectometer. The % reflectance at wavelengths between 380 nm and 800 nm was also measured with a Filmetrics F10-AR reflectometer, and the results appear as FIG. 3.

Examples 2-25

A SKYROL belt was tensioned between two rollers. A sprayer was set up to spray liquid onto the belt upstream of the first roller. A directional gas curtain producing element was placed perpendicular to the first roller. At the beginning of each experiment, the belt was moved at the indicated speed, and the water sprayer was turned on with a specified water flow. The distance between the air knife and the roller, the angle of the gas produced by the directional gas curtain producing element with respect to the ground, and the flow of air through the directional gas curtain producing element were varied in each experiment order to determine the conditions that successfully produce a dry belt downstream from the directional air curtain producing element. Dryness was determined by touching a piece of latex to the moving web; a wet web leaves a mark on the latex whereas a dry web does not. The distance to dry is the distance downstream of the air knife at which the belt was dry. The second roller was 43.2 cm downstream of the directional gas curtain producing element. Thus, a distance to dry of none means that the web was still wet when it reached the second roller. A distance to dry of 0 indicates that the web was at the earliest point downstream of the directional gas curtain producing element that a measurement could be taken.

The results of these experiments are tabulated in Table 2. In Table 2, flux per length is the total flux of air through the directional gas curtain producing element divided by the length of the gas curtain produced by the element. Angle is the angle of the gas curtain with respect to the ground; the gas curtain is perpendicular to the belt in all cases. Water flow is the flux of water sprayed on the belt upstream of the first roller. Gap to belt is the distance between the opening of the directional gas curtain producing element and the wet surface of the belt. Distance to dry is defined above.

TABLE 2

| Ex. No. | Gap to belt (μm) | Flux per Length ($m^2/s$) | Angle (degrees) | Belt Speed (m/s) | Water Flow ($cm^3/s$) | Distance to dry (cm) |
|---|---|---|---|---|---|---|
| 2 | 533 | 0.0427 | 45 | 0.254 | 11.6 | 10.2 |
| 3 | 533 | 0.0427 | 45 | 0.381 | 11.6 | 38.1 |
| 4 | 533 | 0.0427 | 45 | 0.127 | 11.6 | 0 |
| 5 | 533 | 0.0345 | 45 | 0.254 | 11.6 | 22.9 |
| 6 | 533 | 0.0407 | 45 | 0.254 | 11.6 | 17.8 |
| 7 | 533 | 0.0286 | 45 | 0.254 | 11.6 | 43.2 |
| 8 | 406 | 0.0427 | 45 | 0.254 | 11.6 | 0 |
| 9 | 406 | 0.0427 | 45 | 0.381 | 11.6 | 0 |
| 10 | 406 | 0.0427 | 45 | 0.508 | 11.6 | 2.54 |
| 11 | 406 | 0.0427 | 60 | 0.254 | 11.6 | 0 |
| 12 | 533 | 0.0427 | 60 | 0.254 | 11.6 | 43.2 |
| 13 | 660 | 0.0427 | 10 | 0.254 | 11.6 | 5.08 |
| 14 | 533 | 0.0427 | 10 | 0.254 | 11.6 | 5.08 |
| 15 | 914 | 0.0427 | 10 | 0.254 | 11.6 | 7.62 |
| 16 | 533 | 0.0427 | 30 | 0.254 | 11.6 | 12.7 |
| 17 | 533 | 0.0427 | 30 | 0.254 | 6.31 | 10.2 |
| 18 | 533 | 0.0427 | 25 | 0.254 | 11.6 | 0 |
| 19 | 533 | 0.0427 | 35 | 0.254 | 11.6 | 15.2 |
| 20 | 533 | 0.0359 | 30 | 0.254 | 11.6 | 2.54 |
| 21 | 406 | 0.0359 | 30 | 0.254 | 11.6 | 0 |
| 22 | 533 | 0.019 | 30 | 0.254 | 11.6 | 43.2 |
| 22 | 533 | 0.0264 | 30 | 0.254 | 11.6 | 43.2 |
| 24 | 533 | 0.0328 | 30 | 0.254 | 11.6 | 12.7 |
| 25 | 533 | 0.0328 | 30 | 0.127 | 11.6 | 2.54 |

What is claimed is:

1. An apparatus comprising a belt having a first major surface and a second major surface;

a first roller for moving the belt;

a second roller for moving the belt;

the belt tensioned around the first roller and the second roller;

a source of a first self-limiting monolayer forming material and a second self-limiting monolayer forming material;

a deposition station positioned to face the first major surface of the belt, the deposition station comprising a first depositing element to apply a first liquid comprising the first self-limiting monolayer forming material and affix a monolayer of the first self-limiting monolayer forming material to the belt, a rinsing element, and a second depositing element to apply a second liquid comprising the second self-limiting monolayer forming material and affix a monolayer of the second self-limiting monolayer forming material to the belt; and a directional gas curtain producing element and positioned directly downstream from the the second depositing element to provide a gas curtain blowing on the belt in an upstream direction, wherein a gap between the directional gas curtain producing element and the first major surface of the belt is no more than 0.5 mm such that the gas curtain simultaneously meters liquid from the belt and dries the belt.

2. The apparatus of claim 1, wherein at least one of the first self-limiting monolayer forming material depositing element and the second self-limiting monolayer forming material depositing element includes a sprayer.

3. The apparatus of claim 1, wherein the directional gas curtain producing element produces a directional gas curtain having a pressure sufficient to remove liquid, cationic material, or anionic material that is not affixed to the belt.

4. The apparatus of claim 1, wherein the apparatus is capable of affixing a monolayer of cationic material or anionic material to the belt while the belt is moving at a speed of at least 0.25 m/s.

5. The apparatus of claim 1, wherein the belt is an endless belt.

6. The apparatus of claim 1, wherein the first self-limiting monolayer forming material is one and only one of a cationic material or an anionic material; and the second self-limiting monolayer forming material is one and only one of a cationic material or an anionic material;

with the proviso that one and only one of the first self-limiting monolayer forming material and the second self-limiting monolayer forming material is a cationic material and the other is an anionic material.

7. The apparatus of claim 1, wherein the apparatus comprises at least 5 depositing elements.

8. The apparatus of claim 1, wherein a flux of gas of the gas curtain is no less than 0.02 $m^2/s$.

9. The apparatus of claim 1, wherein the first depositing element and the second depositing element each comprises at least one of a rod coater, a knife coater, an air knife coater, a blade coater, a roll coater, a slot coater, a slide coater, a curtain coater, a gravure coater, or a sprayer.

* * * * *